US010054351B1

(12) United States Patent
Saeks

(10) Patent No.: US 10,054,351 B1
(45) Date of Patent: Aug. 21, 2018

(54) TRAY FOR FORMING FROZEN SOLIDS

(71) Applicant: Robert Winston Saeks, Lake Balboa, CA (US)

(72) Inventor: Robert Winston Saeks, Lake Balboa, CA (US)

( * ) Notice: Subject to any disclaimer, the term of this patent is extended or adjusted under 35 U.S.C. 154(b) by 0 days.

(21) Appl. No.: 15/871,881

(22) Filed: Jan. 15, 2018

Related U.S. Application Data

(63) Continuation of application No. 14/216,612, filed on Mar. 17, 2014, now Pat. No. 9,869,503.

(60) Provisional application No. 61/792,642, filed on Mar. 15, 2013.

(51) Int. Cl.
*F25C 1/22* (2018.01)
*F25C 1/24* (2018.01)

(52) U.S. Cl.
CPC . *F25C 1/22* (2013.01); *F25C 1/24* (2013.01)

(58) Field of Classification Search
CPC .... F25C 1/22; F25C 1/24; F25C 1/225; F25C 1/246; F25C 2400/06; F25C 2400/14
USPC ..... 249/130, 119, 126; D15/90
See application file for complete search history.

(56) References Cited

U.S. PATENT DOCUMENTS 4,372,526 A * 2/1983 Daenen ..... A47G 19/30 206/509
D271,769 S * 12/1983 Daenen ..... D15/90

FOREIGN PATENT DOCUMENTS

CA 2253645 * 4/1998 ..... F25C 1/24

* cited by examiner

*Primary Examiner* — Cassey D Bauer
(74) *Attorney, Agent, or Firm* — Briggs and Morgan, P.A.; Audrey J. Babcock

(57) ABSTRACT

A tray for forming frozen solids such as ice cubes is described. The tray includes a plurality of cavities, each cavity having a base, sidewalls, and a top edge. An overflow notch including an aperture is located in the top edge of each cavity. The overflow notch is of a sufficient depth such that when the tray is filled with liquid up to the level of the overflow notch, and then placed in a freezer to form cubes of frozen solids, connections of frozen solid are not formed between the cubes, even if the liquid expands when it freezes.

20 Claims, 13 Drawing Sheets

SECTION A-A
SCALE 1 : 3

DETAIL B
SCALE 1.5 : 1

TRAY FOR FORMING FROZEN SOLIDS

RELATED APPLICATIONS

This application is a continuation of U.S. patent application Ser. No. 14/216,612, filed on Mar. 17, 2014, which claims the benefit of priority of U.S. Provisional Patent Application No. 61/792,642, filed on Mar. 15, 2013, each of which applications is incorporated by reference herein.

TECHNICAL FIELD

The present invention relates to molds or trays designed to form uniformly shaped frozen solids, such as ice cubes.

BACKGROUND OF THE INVENTION

Molds or trays for forming ice are a common item in many freezers. They are typically filled by holding a tray beneath a stream of water or other liquid. If multiple trays of ice are desired, they must be filled one at a time. This is inconvenient and tedious.

Another problem is that it is difficult to fill the cavities in a tray uniformly without overfilling them. If a person overfills the cavities of a tray a sheet of ice forms, connecting the cubes. Even if the cavities in a tray are not overfilled it is still possible for interconnecting ice to form between cavities because water expands 9% in volume when it freezes. These connections make it difficult to remove the ice, especially if one wishes to remove the cubes individually. People may twist the ice tray to attempt to break the connections between the ice cubes, but the connections cannot always be broken by twisting the tray alone. To avoid these connections between ice cubes, people may either intentionally under-fill the cavities, or tilt the tray back and forth during or after filling, then pour off any excess liquid in an attempt to fill all of the cavities evenly without overfilling them. The cubes formed using these techniques are frequently irregular in both size and shape.

An apparatus for filling multiple trays simultaneously is shown in U.S. Pat. No. 4,815,691. The use of that apparatus would result in interconnected ice cubes, and involves a cumbersome outer vessel that is flooded and then drained to fill all of the trays at once. Canadian Patent Application No. 2,253,645 also shows an apparatus for filing multiple trays simultaneously. However, the design of that apparatus does not compensate for the expansion of water when it freezes into ice, so it may still be possible for interconnections to form between ice cubes. An ice cube tray including depressions in the top wall of the tray is shown in U.S. Pat. No. 4,148,457. However, that patent does not disclose a way of filling multiple trays simultaneously, and the tray does not include apertures through which excess water may exit the tray.

SUMMARY OF THE INVENTION

The present invention is directed to an ice cube tray with a design element that allows for multiple trays to be filled simultaneously. The ice cubes formed in the tray of the present invention are uniform and devoid of any frozen connections between cubes. The tray is also designed to minimize over-splash while filling, even if the liquid source is some distance above the top of the tray.

The present invention is not limited to use as an ice cube tray. The tray of the present invention may be used to prepare various frozen foods, such as popsicles, or foods that may set or thicken in molds, such as pudding and gelatin desserts. Trays in accordance with the present invention, when made from materials which can withstand baking temperatures, may also be used to prepare baked goods made from batter, such as cakes and brownies. The batter may be poured into the trays, and then baked within the trays.

The present invention may also be used for non-food applications in which molds are used. For example, molten plastic or resins may be poured into molds made in accordance with the present invention and allowed to harden into forms determined by the molds.

In one embodiment, the present invention is directed to a tray for forming frozen solids including a cavity having a base, sidewalls, and a top edge, wherein an overflow notch including an aperture is located in the top edge. The overflow notch extends down a sidewall of the cavity to a sufficient depth such that when the tray is filled with liquid and then placed in a freezer to form cubes of frozen solids, such as ice cubes, connections of frozen solid are not formed between the cubes, even if the liquid expands when it freezes.

In one embodiment, the present invention is directed to a tray for forming frozen solids including a plurality of cavities, each cavity having a base, sidewalls, and a top edge. An overflow notch including an aperture is located in the top edge of each cavity. The overflow notch extends down a sidewall of the cavity to a sufficient depth such that when the tray is filled with liquid and then placed in a freezer to form cubes of frozen solids, such as ice cubes, connections of frozen solid are not formed between the cubes, even if the liquid expands when it freezes.

In one embodiment, the invention is directed to a method of forming frozen solids. The method includes providing a tray including a plurality of cavities, each cavity having a base, sidewalls, and a top edge, wherein an overflow notch having an aperture is located in the top edge of each cavity. The tray is filled with liquid until each cavity contains liquid up to the level of the aperture of the overflow notch. The tray is then placed in a freezer. It is removed from the freezer when the liquid in each cavity has frozen, such that each cavity contains a frozen solid, and the frozen solid in each cavity extends from the base of the cavity to a level at or below a highest level of the top edge of the cavity. The method may also include providing a plurality of trays and stacking them on top of each other prior to filling the top tray with a liquid, thereby allowing liquid to flow through the apertures into lower trays in the stack, and allowing multiple trays to be filled simultaneously.

An object of the present invention is to provide an ice cube tray designed to allow multiple trays to be filled simultaneously. The tray of the present invention may also be set down and filled from above with minimal splashing, and without having to hold it in one's hands to direct the water into different cavities.

Another object of the present invention is to provide an ice cube tray that compensates for the expansion of water when it changes state from a liquid to a solid.

A further object of the present invention is to provide an ice cube tray which forms ice cubes of a uniform size, with no ice connections formed between adjacent ice cubes.

A further object of the present invention is to provide an ice cube tray including overflow notches which enable the tray to be twisted easily, thereby facilitating the release of the ice cubes.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
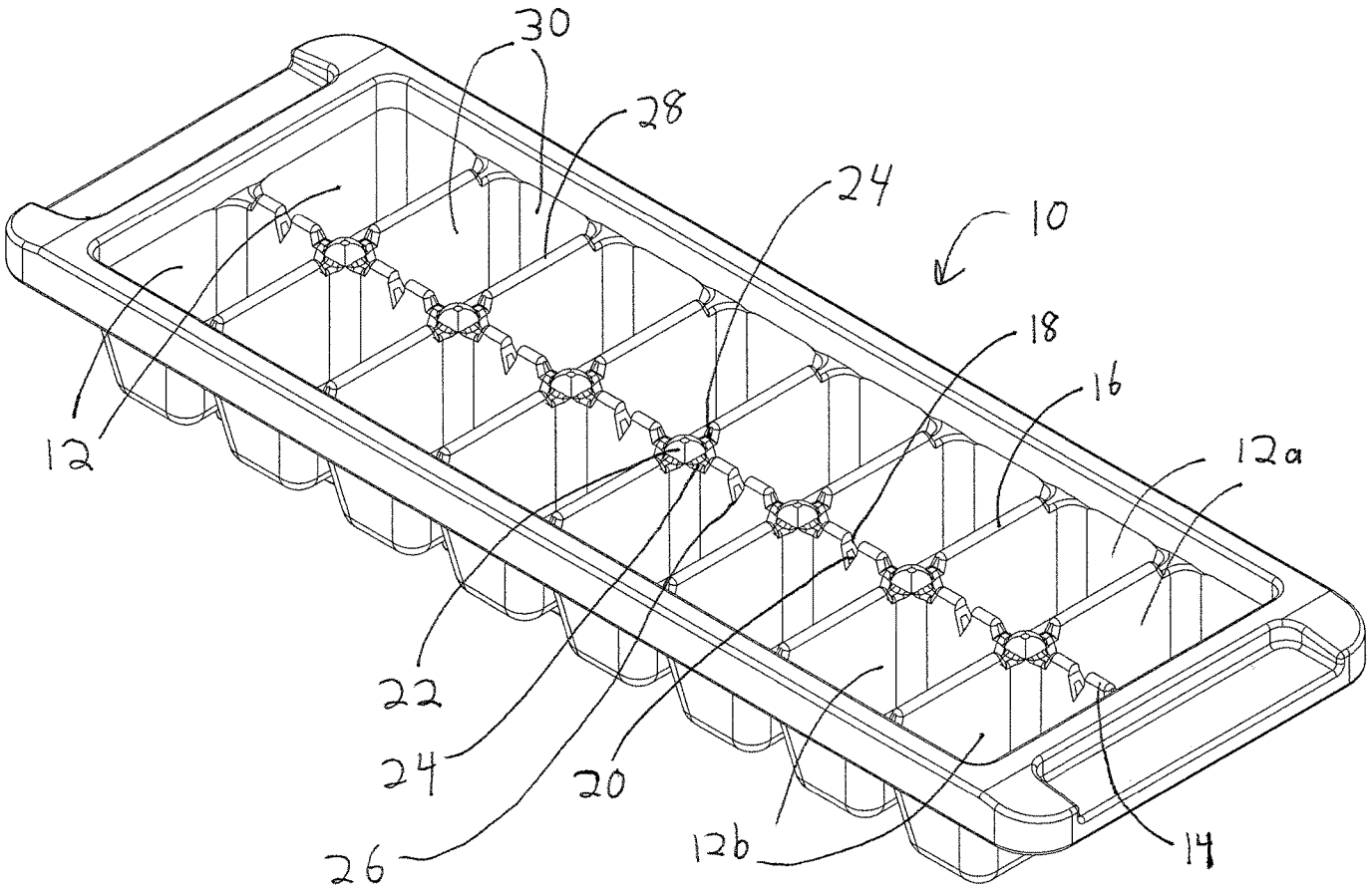
FIG. 1 is a perspective view of an embodiment of the present invention.
Figure 2:
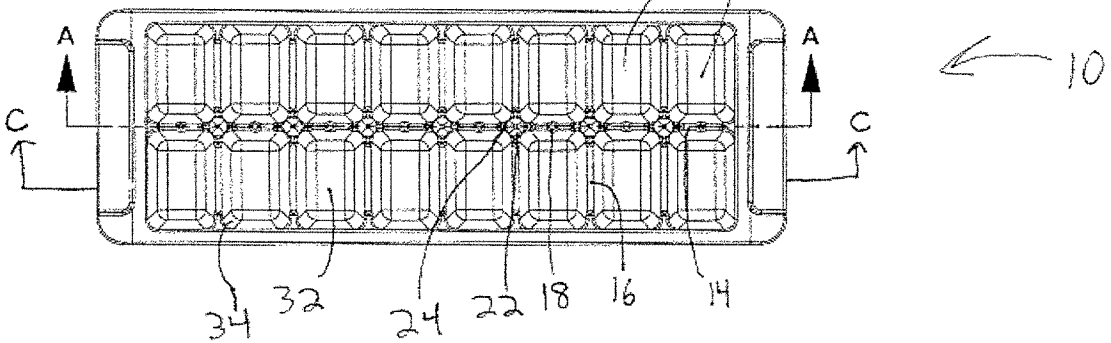
FIG. 2 is a top plan view of the tray of FIG. 1.

As shown in FIG. 1, one embodiment of the present invention is an ice cube tray 10 including a plurality of interconnected cavities 12 for forming ice cubes. FIG. 2 is a top view of the tray which is shown in perspective view in FIG. 1. The tray 10 may be made from a variety of different materials, such as but not limited to a single piece of molded plastic, pressure die cast material, or sheet metal. It is preferable for the tray 10 to be made from a material which remains pliable at cold temperatures, such as high density polyethylene (HDPE), so that the removal of frozen solids may be facilitated by applying a twisting motion to the tray. The use of HDPE also creates a low friction surface which allows frozen solids to easily slide out of the tray 10. In some embodiments of the invention, the trays may be shaped by vacuum forming.

Laterally adjacent cavities 12*a* and 12*b* are located on opposite sides of each longitudinal partition 14. The longitudinal partitions 14 are parallel to a longitudinal axis of the tray. The longitudinal partitions 14 divide the tray 10 into two rows of cavities 12.

In the embodiment shown in the figures, the trays include two rows of eight cavities 12. However, in other embodiments, the trays may include a fewer or greater number of rows of cavities. The trays may also include a fewer or greater number of cavities in each row. Therefore, although the embodiment shown in the figures includes 16 cavities, embodiments with various numbers of cavities, such as from 4 to 24 cavities, or 6 to 18 cavities, may be made in accordance with the present invention.

Figure 3:
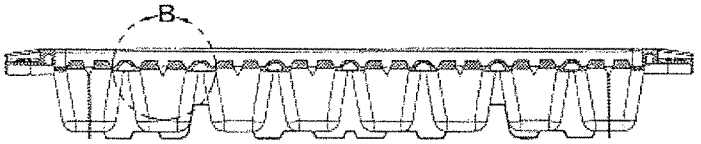
FIG. 3 is a cross-sectional view of the tray of FIG. 2, taken along line A-A.
Figure 4:
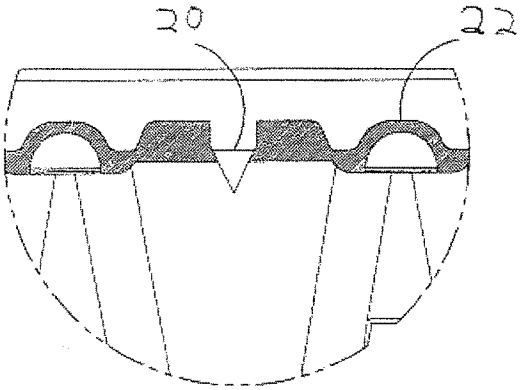
FIG. 4 is an enlarged view of the circled portion of the tray shown in FIG. 3.
Figure 5:
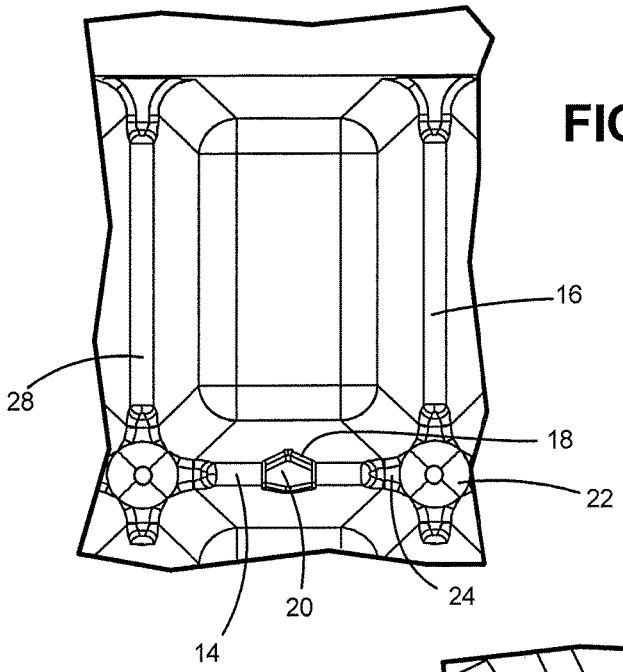
FIG. 5 is a top view of a cavity of the tray of FIG. 1.
Figure 6:
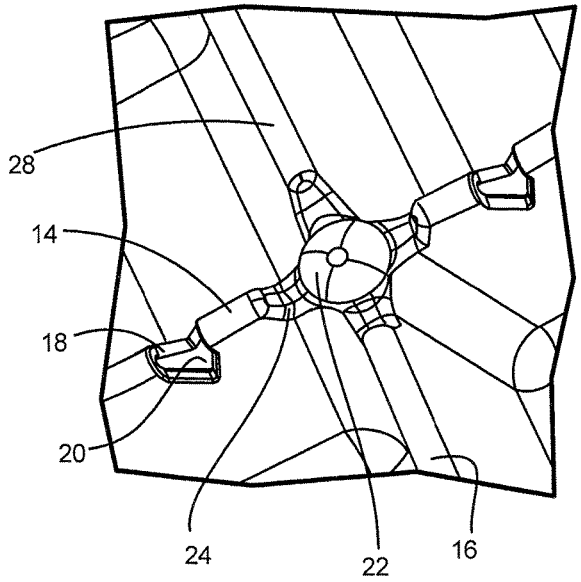
FIG. 6 is a partial view of four adjacent cavities of the tray of FIG. 1.
Figure 7:
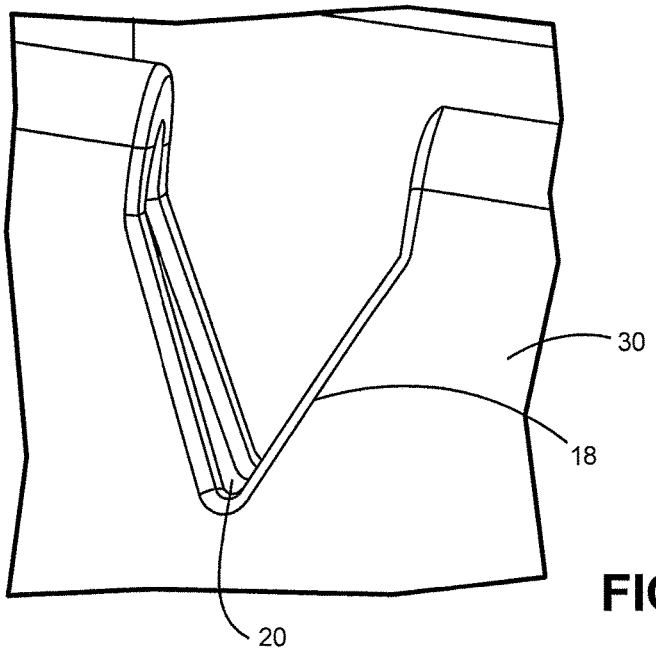
FIG. 7 is a perspective view of a notch of the tray of FIG. 1.
Figure 8:
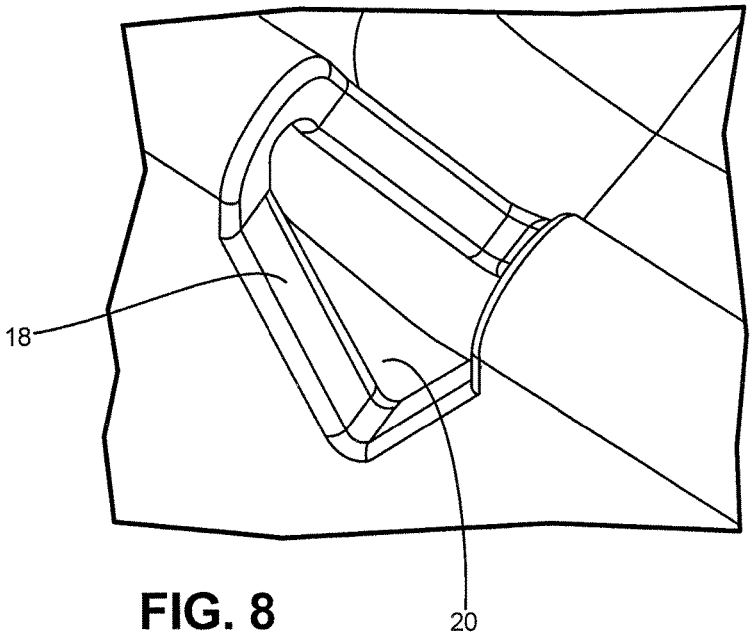
FIG. 8 is another perspective view of the notch of FIG. 7.

Lateral partitions 16 are located between adjacent cavities 12*a* and 12*b* in each row. A generally synclinal or V-shaped overflow notch 18 is located in each longitudinal partition 14. Each overflow notch 18 includes an aperture 20 which allows liquid to drain out of the tray 10. A cross-sectional view illustrating the overflow notches 18 is shown in FIG. 3, which is a cross-section taken along line A-A of FIG. 2, and in FIG. 4, which is an enlarged view of portion B of FIG. 3.

Detailed views of the overflow notches 18 are shown in FIGS. 5-8. In a preferred embodiment, the overflow notches 18 are V-shaped, as shown in the figures. The greater the width of the overflow notch at any given liquid level in a cavity, the faster the liquid is able to flow out of the notch. Therefore, when a stack of trays is being filled at once by pouring liquid into the top tray of the stack, an increase in the width of the notch causes the liquid to be conveyed to the lower trays more quickly, resulting in a more efficient filling process. Once all of the cavities in the stack of trays are full, the person filling the trays stops the flow of liquid into the top tray and waits for the liquid level to settle at the bottom of the notches. After the liquid level has settled at the bottom of the notches, further flow of liquid out of the notches, such as when the user moves the stack of trays from a sink to a freezer, is undesirable. However, because the bottoms of the notches are narrow due to their V-shape, the surface tension of the water (or other liquid in the trays) minimizes the amount of liquid which exits the notches after the liquid level has settled at the bottom of the notches. Therefore, the narrow base of the V-shaped notches reduces the likelihood that liquid will exit through the notches and out of the trays after the liquid level has settled. This minimizes drips while the stack of filled trays is transported from the filling location to the freezing location. Accordingly, a V-shaped overflow notch with a narrow base and a wide top provides advantages, both during the filling of trays with liquid and during the transporting of filled trays. On the other hand, if overflow notches 18 are too wide, liquid will drain out of the apertures 20 so quickly that the liquid will not have time to flow evenly into all of the cavities 12. Therefore, a preferred overflow notch 18 will be sufficiently wide to allow a stack of trays 10 to be efficiently filled with liquid, while being sufficiently narrow to allow liquid to drain out of a tray at a rate which is slower than the rate at which liquid is poured into the tray.

As discussed above, the embodiment shown in the figures includes V-shaped overflow notches 18. However, in other embodiments, the notches may be a variety of different shapes, such as but not limited to square, U-shaped, or rectangular. Also, the overflow notches may have a greater depth than width, a greater width than depth, or an equal depth and width.

In the embodiment shown in the figures, the overflow notches 18 are located at the top of approximately the center of each longitudinal partition 14. The placement of overflow notches 18, and the associated apertures 20, in the longitudinal partitions 14 makes it easier to twist the tray 10 to facilitate the ejection of frozen solids. Also, for a tray 10 of the type shown in the figures, locating an overflow notch 18 in each longitudinal partition 14, rather than in each lateral partition 16, allows a tray to be made with fewer notches. The location of overflow notches 18 in the longitudinal partitions 14 also facilitates the flow of liquid from one row of cavities 12 to the other. However, in other embodiments, the locations and the number of the overflow notches 18 may be varied. For example, overflow notches 18 may be placed in the lateral partitions 16, instead of or in addition to the overflow notches 18 in the longitudinal partitions 14. The overflow notches 18 may also be located in different positions in the longitudinal partitions 14. Further, an overflow notch 18 need not be located in every longitudinal partition 14, or in every lateral partition 16. More than one overflow notch 18 could also be located in one or more of the longitudinal partitions 14 and/or lateral partitions 16, instead of including only one overflow notch 18 in each longitudinal partition 14.

As shown in FIG. 1, raised features 22 are located at the points where the longitudinal partitions 14 and the lateral partitions 16 between the cavities 12 meet. When liquid poured into the tray 10 is directed so that it falls on a raised feature 22, the raised feature helps to minimize the splashing that may occur when liquid is poured into the tray. The raised features 22 also aid in conveying the liquid into the cavities 12, and therefore serve a flow-directing function. Depressions 24 are located at the ends of longitudinal partitions 14 and latitudinal partitions 16, adjacent to the raised features 22. These depressions 24 facilitate the flow of liquid between the cavities, especially when liquid is poured into the tray 10 at a faster rate than the liquid drains from the tray through apertures 20. Trays in accordance with the present invention may also be formed without depressions 24. In some embodiments, the longitudinal partitions 14 and lateral partitions 16 may have a lower height. For example, in an example of an embodiment which does not include depressions 24, the height of the partitions 14, 16 could reach approximately the lowest level of the depressions 24 of the embodiment shown in the figures.

In the embodiment shown in the figures, the raised features 22 at the intersections of the cavities, to minimize splashing, are in the form of convex hemispheres. However, in other embodiments, the raised features 22 at the intersections of the cavities may possess different shapes which protrude upward, such as but not limited to a pyramid shape, a truncated pyramid shape with trapezoid-shaped sides, or a half-egg shape with an oval lateral cross-section. Trays in accordance with the present invention may also be formed without the inclusion of raised features 22 which minimize splashing.

Figure 9:
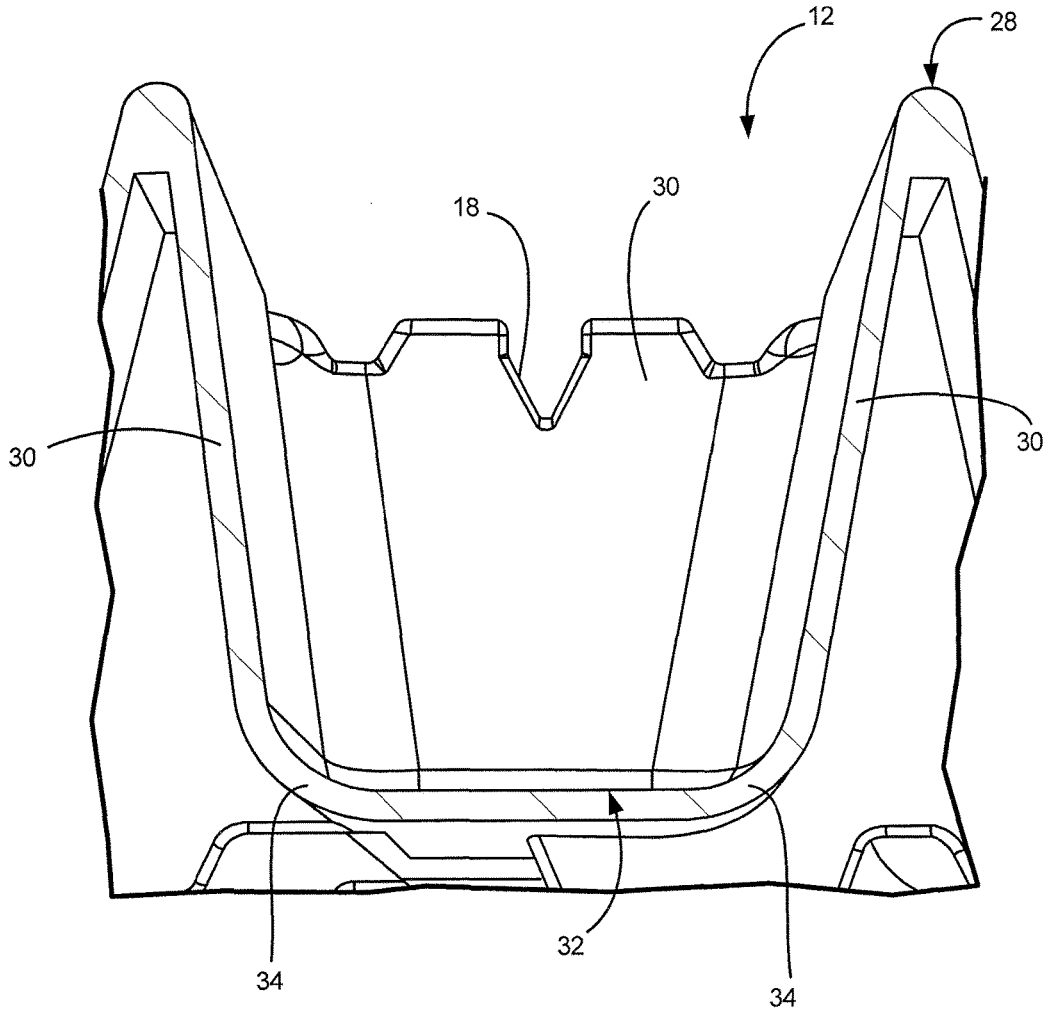
FIG. 9 is a partial cross-sectional view of the tray of FIG. 2, taken along line C-C.

FIG. 9 is a partial cross-sectional view of the tray 10, taken along line C-C of FIG. 2. As shown in FIG. 9, the depressions 24 do not extend as far into the longitudinal partitions 14 as the overflow notches 18. The tray 10 is designed in this manner so that the liquid level will be below the depressions 24 prior to freezing. The liquid level will be no higher than the lowest points 26 of the overflow notches 18, because additional liquid will exit the tray 10 through the apertures 20 in the overflow notches 18.

When ice cubes are made using the embodiment of tray 10 shown in the figures, the top level of the ice cubes reaches approximately the lowest point of depressions 24. However, in other embodiments, the tray 10 could be shaped such that the top level of ice cubes formed in the tray is either above or below the lowest point of depressions 24.

As shown in FIG. 9, each cavity 12 has sidewalls 30 which slope downward from the top edge 28 to the base 32 of the cavity. Therefore, a cross-section of each cavity 12 has a trapezoidal shape. There are rounded corners 34 where the sidewalls 30 of each cavity 12 meet the base 32. In other embodiments, the cavities 12 may have a different shape, such as but not limited to a cylindrical, hemispherical, or cubic shape. The cavities may also be of various sizes. In some embodiments, cavities of more than one size may be included in a single tray. The overflow notches 18 extend from the top edge 28 of the cavity 12 down sidewalls 30. The overflow notches 18 may also be described as extending from the top edge 28 of the cavity 12 down longitudinal partitions 14, because each longitudinal partition 14 includes two sidewalls 30, with one sidewall 30 being a sidewall of a cavity 12*a*, and another sidewall 30 being a sidewall of an adjacent cavity 12*b*.

Figure 11:
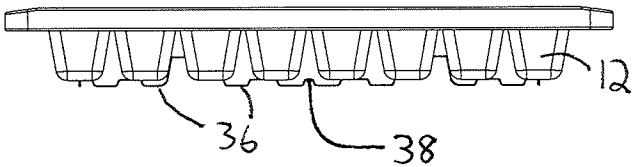
FIG. 11 is a side view of the tray of FIG. 1.
Figure 12:
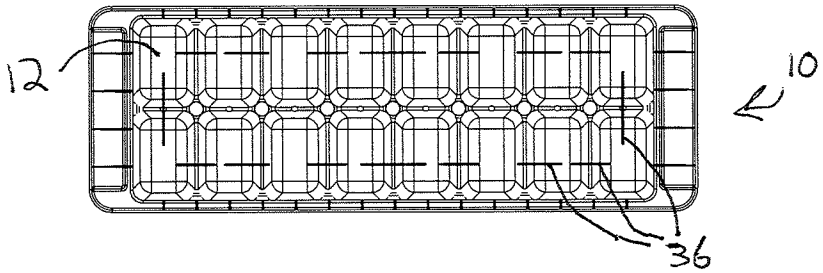
FIG. 12 is a bottom plan view of the tray of FIG. 1.
Figure 10:
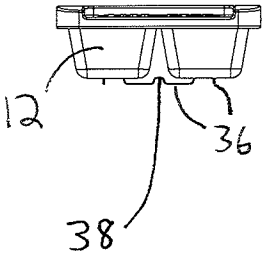
FIG. 10 is an end view of the tray of FIG. 1.

FIGS. 10, 11, and 12 illustrate an end view, a side view, and a bottom view of the tray 10 of FIG. 1, respectively. As shown in these figures, ridges 36 extend from the bottom of the tray 10. These ridges 36 provide structural support to the tray 10. Indentations 38 are included in the ridges 36 to facilitate the stacking of trays 10, as an indentation 38 of a top tray may rest on a longitudinal partition 14 or a lateral partition 16 of the tray beneath the top tray.

To use the tray of the present invention, the user may first stack the desired number of trays 10 on top of one another. The stack may then be placed on a flat surface, positioned so that one of the raised features 22 at an intersection of the cavities 12 of the topmost tray is beneath a stream of liquid, such as a stream of water from a faucet. As the liquid contacts the raised feature 22 at the intersection, it is conveyed into the cavities 12 of the tray 10. As the cavities of the topmost tray become full, excess liquid exits through the overflow notches 18 between the cavities 12 and flows into the cavities of the tray beneath it. The water tends to flow down sidewalls 30 of the tray beneath the topmost tray. Specifically, the water flows down the sidewalls 30 which include overflow notches 18. This process repeats itself until the cavities 12 of the bottommost tray are filled. The user may then shut off the liquid supply and wait a few seconds for the liquid level to reach the overflow notches 18 of the bottommost tray. The user may then place the trays 10 into the freezer. Once the liquid in the trays is frozen, the user may eject the cubes of frozen solid from the trays 10 using a twisting motion or by other conventional means. Because the design of the present invention prevents interconnections of frozen solid from being formed between the cubes, the trays 10 may be twisted easily to eject the cubes, due to the absence of interconnections of frozen solid which would need to be broken in order to eject individual cubes.

It has been observed that, when ice cubes are made using the embodiment depicted in the figures, there is no noticeable difference in appearance between the side of the cube that was formed against the sidewall 30 including the overflow notch 18, and the side of the cube that was formed against the sidewall 30 opposite to the overflow notch 18. Therefore, the presence of the overflow notch 18 in one sidewall 30 of each cavity did not create any irregularities or lack of symmetry in the ice cubes. Ice cubes prepared using tray 10 have the uniformity of ice cubes obtained from some automated ice makers.

Without intending to be bound by theory, it is believed that, because ice is less dense than water, initially as liquid water freezes in tray 10 a layer of ice will be present on the top surface of the water. As the water continues to freeze, the ice at the top surface will be pushed upward. Because the ice at the top surface is already solid, it will not flow into notches 18 as it is pushed upward past the lowest point 26 of overflow notches 18. Consequently, the presence of notches 18 in some but not all of the sidewalls 30 does not create any irregularities or lack of symmetry in ice cubes made using tray 10.

A tray 10 or a stack of trays 10 may be placed on a carrying tray to allow the tray or trays to be easily transported, and to catch drips from the tray or trays. A carrying tray may be shaped to include raised portions which project upward from the base of the carrying tray and which complement the shape of the underside of a tray 10, in order to prevent the tray 10 from sliding along the surface of the carrying tray. The carrying tray may be placed in the freezer along with the tray or trays 10 which it holds.

Figure 13:
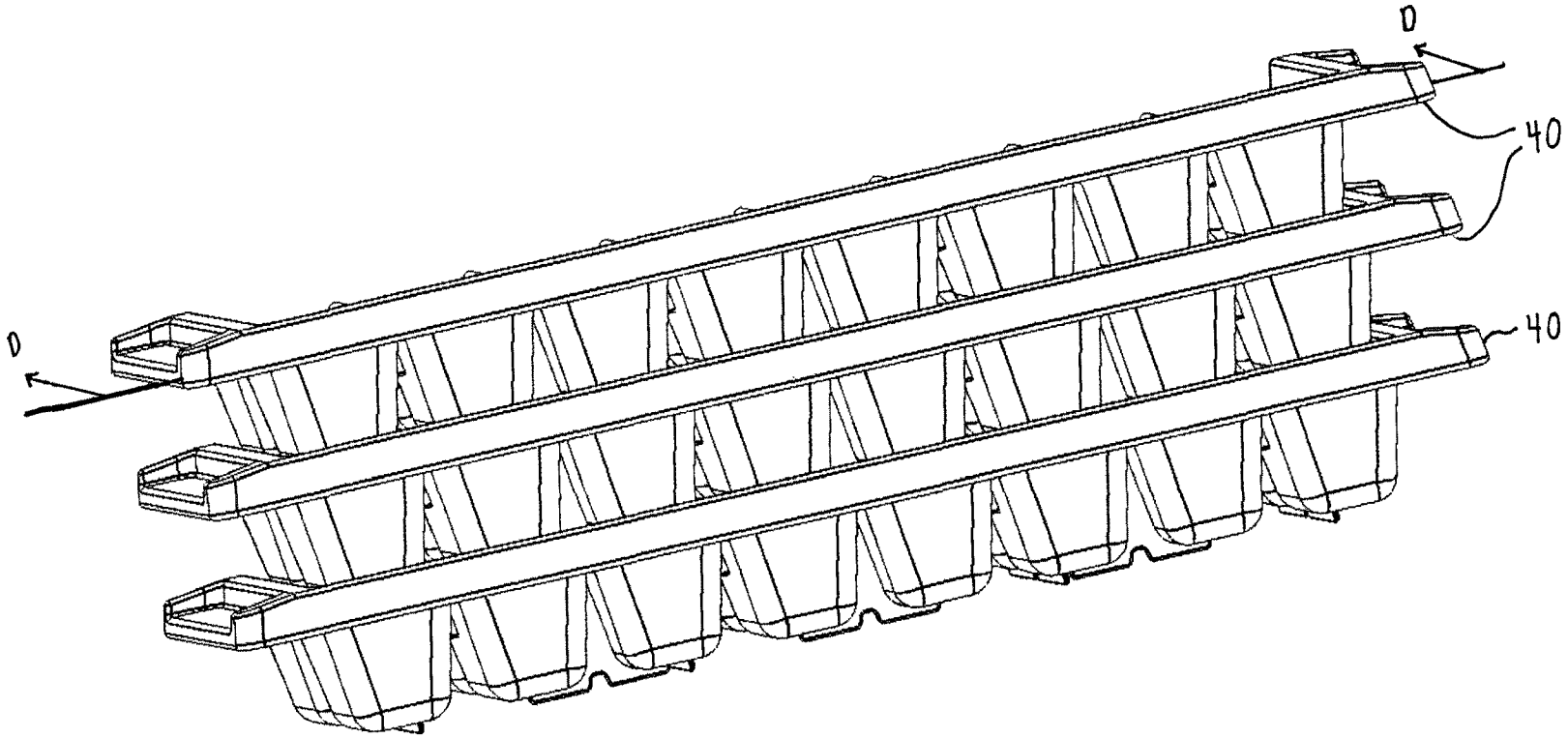
FIG. 13 is a perspective view of three trays in a stack, wherein the trays shown are a second embodiment of a tray of the present invention.
Figure 14:
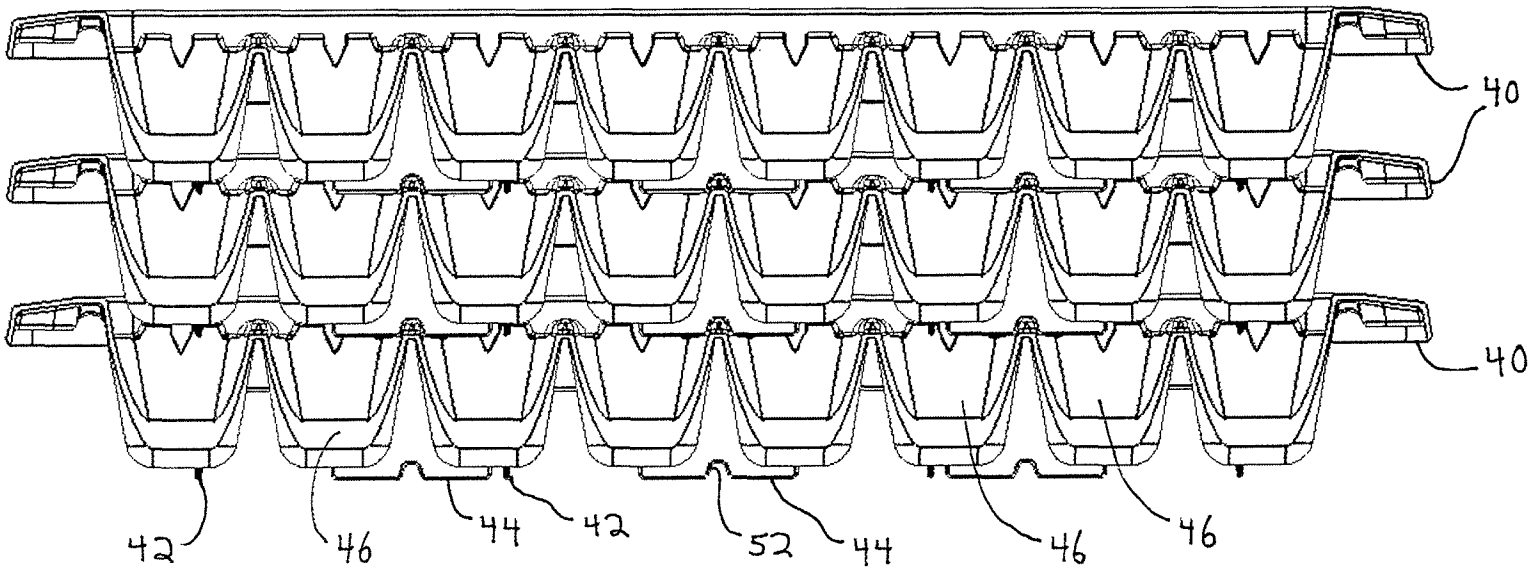
FIG. 14 is a side cross-sectional view of the stack of three trays shown in FIG. 13, taken along line D-D of FIG. 13.
Figure 15:
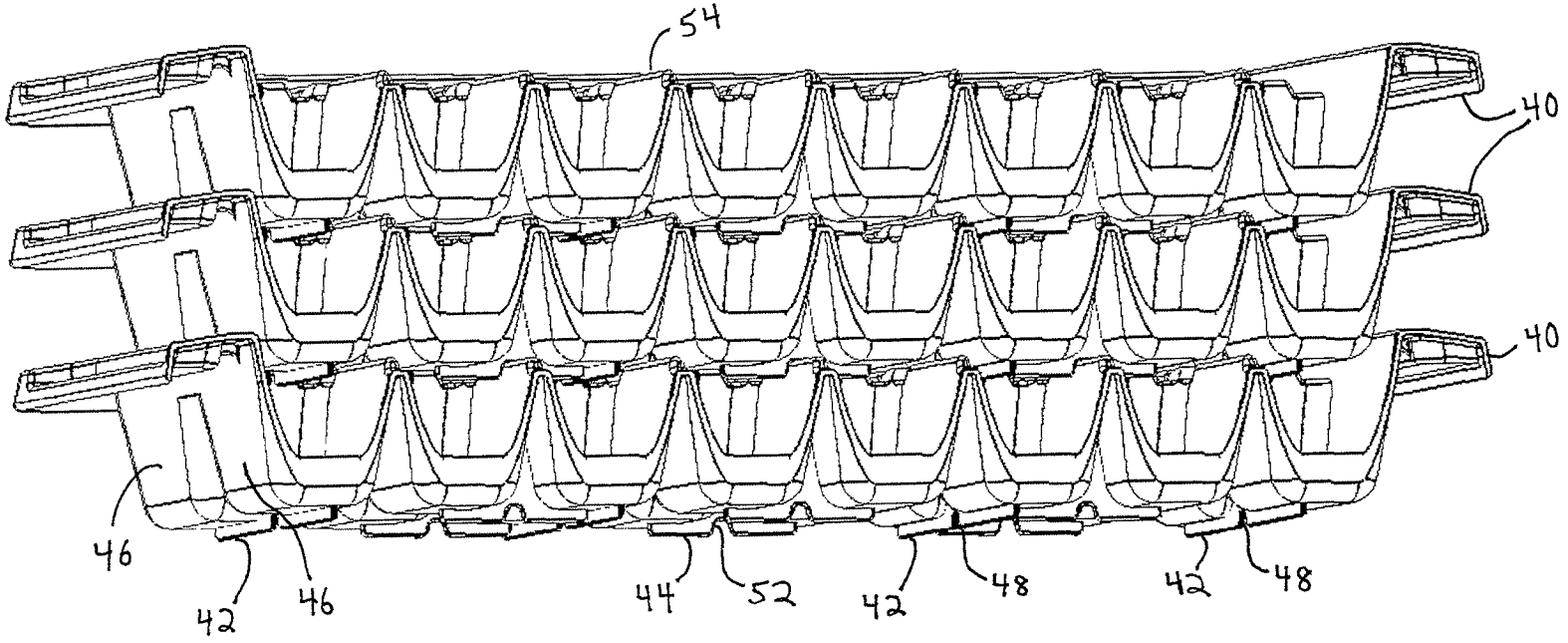
FIG. 15 is a perspective cross-sectional view of the stack of three trays shown in FIG. 13, taken along line D-D of FIG. 13.
Figure 16:
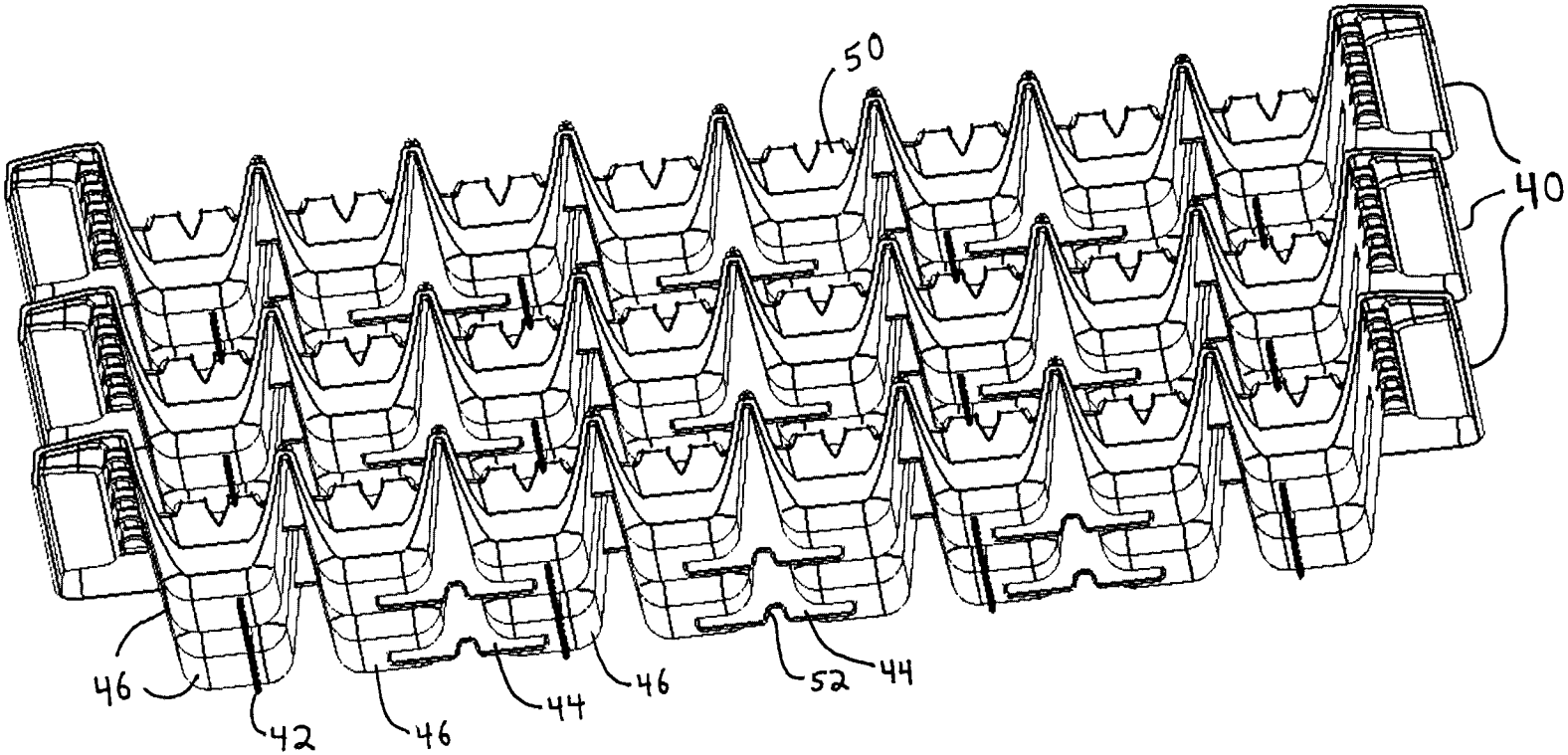
FIG. 16 is a perspective cross-sectional view of the stack of three trays shown in FIG. 13, taken along line D-D of FIG. 13.
Figure 17:
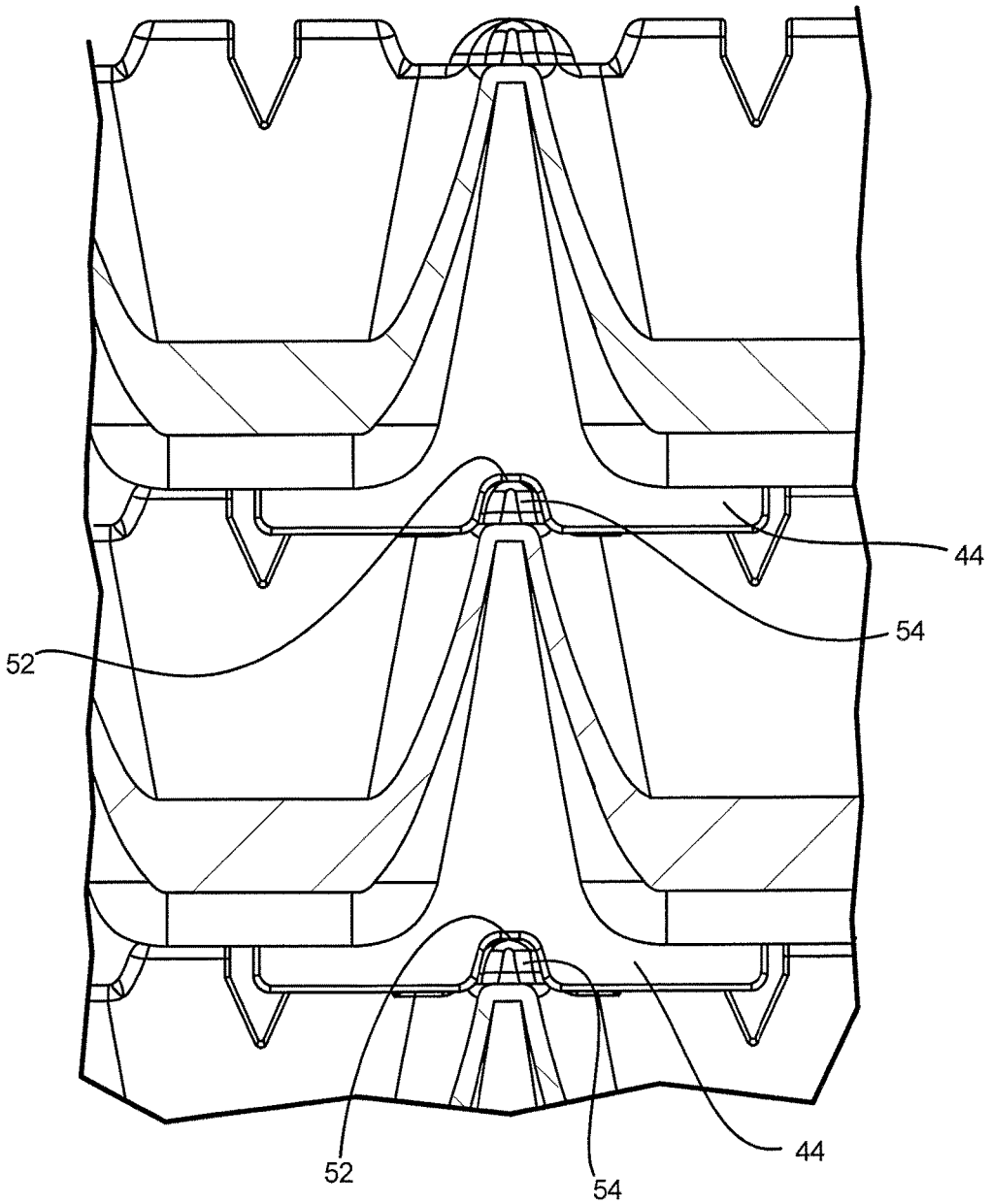
FIG. 17 is a side cross-sectional view of a portion of the stack of trays shown in FIG. 13, taken along line D-D of FIG. 13.
Figure 18:
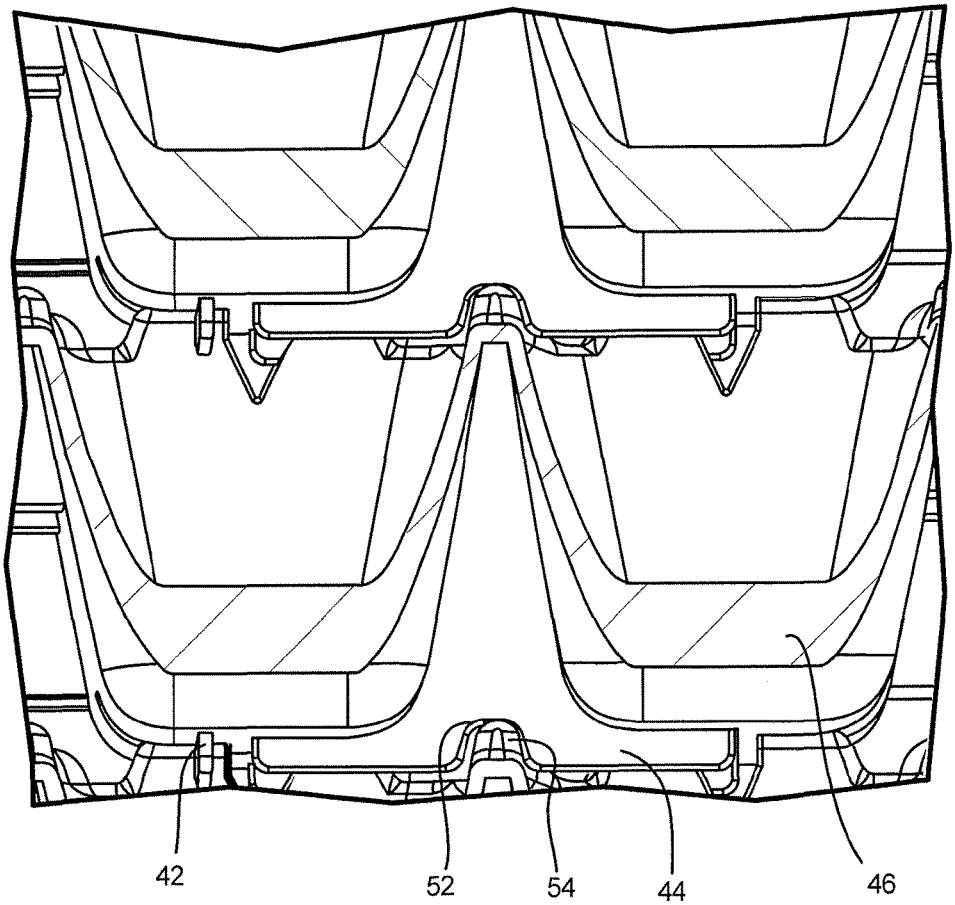
FIG. 18 is a perspective cross-sectional view of a portion of the stack of trays shown in FIG. 13, taken along line D-D of FIG. 13.
Figure 19:
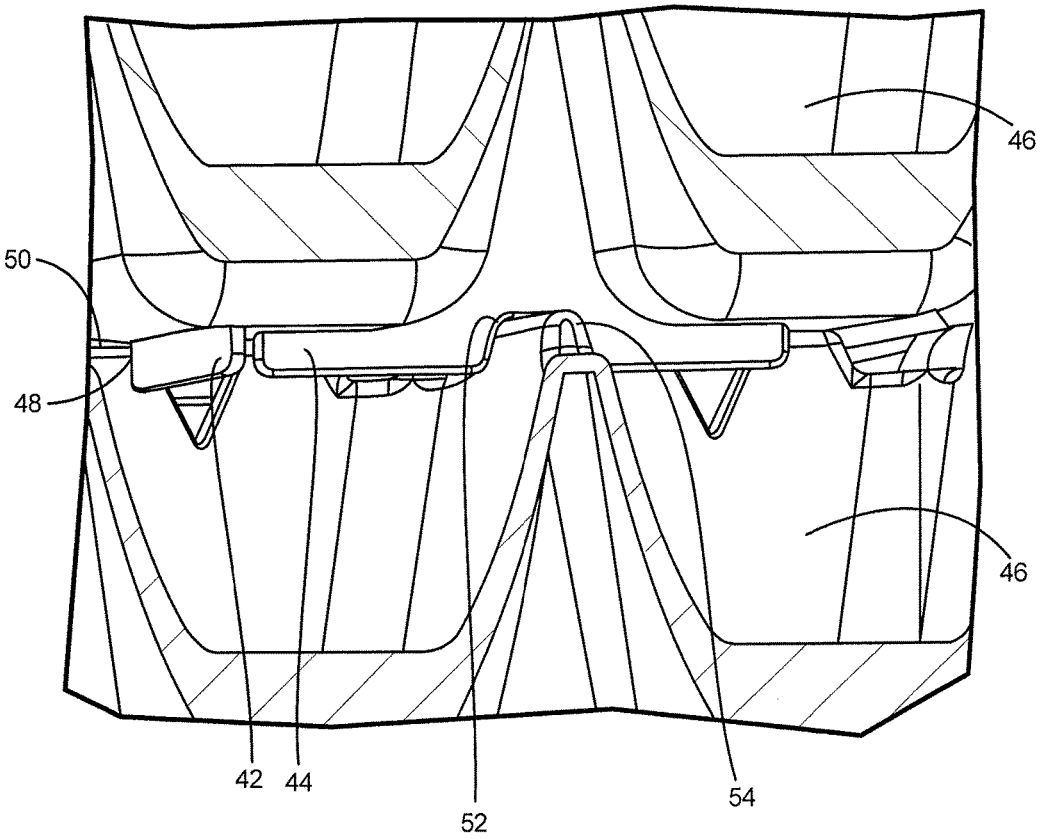
FIG. 19 is a perspective cross-sectional view of a portion of the stack of trays shown in FIG. 13, taken along line D-D of FIG. 13.

FIG. 13 is a perspective view of three trays 40 in a stack. FIGS. 14-16 are cross-sectional views of the stack of three trays, taken along line D-D of FIG. 13. FIG. 14 shows a side view of the cross-section, while FIGS. 15 and 16 show perspective views of the cross-section. Detailed cross-sectional views, taken along line D-D of FIG. 13, of portions of stacked trays 40 are shown in FIGS. 17-19. FIG. 17 shows a side view of the cross-section, while FIGS. 18 and 19 show perspective views of the cross-section. Tray 40 is a different embodiment from tray 10 discussed above, in that the ridges 42, 44 extending from the bottom of tray 40 differ from the ridges 36 of tray 10. Lateral ridges 42 extend across adjacent cavities 46 in separate rows, while longitudinal ridges 44 extend across adjacent cavities in the same row. Indentations 48 of lateral ridges 42 are included to facilitate the stacking of trays 40, as an indentation 48 of a top tray may rest on a longitudinal partition 50 of the tray beneath the top tray. Similarly, indentations 52 of longitudinal ridges 44 are included to facilitate the stacking of trays 40, as an indentation 52 of a top tray may rest on a lateral partition 54 of the tray beneath the top tray.

The following equations relate to the geometry of the embodiment of the present invention depicted in FIGS. 1-12. The geometric shape of the cavities 12 in the embodiment depicted in the figures is an inverted truncated pyramid. It may also be considered an inverted frustum of a pyramid. In the following discussion, this form shall be referred to as a truncated pyramid.

1) Because the expansion factor of water is approximately 9% when water changes state from a liquid to a solid, the following equation is applicable when the cavities 12 are filled with pure water:

$$V_1 \times 1.09 = V_2, \text{ or alternatively,}$$

$$V_2/1.09 = V_1$$

where $V_1$ is the volume of water when the cavity 12 is filled to the lowest point 26 of the overflow notch 18, and $V_2$ is the volume of water when the cavity 12 is filled to the lowest point of depressions 24.

2) When the overall dimensions of the cavity 12 are known, $V_2$ can be determined using the equation for the volume of a truncated pyramid, as follows:

$$V_2 = \{h_2 \times [(B_1 + B_2) + \text{sqrt}(B_1 B_2)]\}/3$$

where $V_2$ is the volume of water when the cavity 12 is filled to the lowest point of depressions 24 with water, $h_2$ is the height of the cavity from the base 32 to the lowest level of depressions 24, and $B_1$ is the area of the base 32 of the cavity. $B_2$ is the area of a plane bisecting the cavity 12 at the lowest points of depressions 24, wherein the plane is parallel to the base 32.

3) In order to find the correct area equation to solve for $B_1$ and $B_2$, the shapes which define areas $B_1$ and $B_2$ must be identified. In the preferred embodiment, the areas $B_1$ and $B_2$ are both defined by rectangles with rounded corners. Therefore the following equation is applicable:

$$A = LW - (4 - \pi) r^2$$

where A is the area of the rectangle with rounded corners, L is the length of the longer sides of the rectangle, W is the length of the shorter sides of the rectangle, and r is the radius of the curve that describes the rounded corners.

4) Using the above equation, the area of the base 32 of the cavity, $B_1$, may be calculated as follows:

$$B_1 = (L_1 W_1) - (4 - \pi) r^2,$$

where $L_1$ is the length of each of the longer sides of base 32, $W_1$ is the length of each of the shorter sides of base 32, and r is the radius of the curve that describes the rounded corners of base 32. Similarly, $B_2$, the area of a plane bisecting cavity 12 and defined by the lowest points of depressions 24, may be calculated as follows:

$$B_2 = (L_2 W_2) - (4 - \pi) r^2.$$

where $L_2$ is the length of each of the longer sides of the rectangle defining $B_2$, $W_2$ is the length of each of the shorter sides of the rectangle defining $B_2$, and r is the radius of the curve that describes the rounded corners of $B_2$. Because $L_1$, $L_2$, $W_1$, $W_2$, and r may be measured, the values of $B_1$ and $B_2$ may be calculated.

5) Once $B_1$ and $B_2$ are calculated, $V_2$, the volume of the cavity from the bottom to the top, may be calculated using the following equation, which was set forth in step 2:

$$V_2 = \{h_2 \times [(B_1 + B_2) + \text{sqrt}(B_1 \times B_2)]\}/3$$

where $h_2$ is the height of the cavity 12 from the base 32 to the lowest level of depressions 24, $B_1$ is the area of the base 32 of the cavity, and $B_2$ is the area of a plane bisecting the cavities and defined by the lowest points of depressions 24, wherein the plane is parallel to the base 32.

6) Once $V_2$ is calculated, $V_1$, the volume of water when the cavity 12 is filled to the lowest point 26 of the overflow notch 18, may be calculated as follows:

$$V_2/1.09 = V_1$$

7) The equation for $V_1$, which may also be described as the volume of the cavity 12 from the base 32 to the lowest point 26 of the notch 18, may be written as:

$$V_1=\{h_1\times(B_1+((L_3W_3)-(4-\pi)r^2))+\text{sqrt}(B_1\times((L_3W_3)-(4-\pi)r^2))\}/3$$

or alternatively, $$V_1=\{h_1\times(B_1+B_3)+\text{sqrt}(B_1\times B_3)\}/3$$

where $h_1$ is the height of the cavity 12 from the base 32 to the lowest point 26 of the overflow notch 18, $B_1$ is the area of the base 32 of the cavity, $B_3$ is the area of a plane parallel to base 32, which bisects the cavity at the lowest point 26 of the overflow notch 18, $L_3$ is the length of each of the longer sides of the rectangle which defines $B_3$, $W_3$ is the length of each of the short sides of the rectangle which defines $B_3$, and r is the radius of the rounded corners of the cavity.

8) The area of the base 32 of a cavity, $B_1$, is constant. However, the area of $B_3$ varies in relation to height $h_1$. Accordingly, the area of the larger base of the truncated pyramid, $B_3$, is a function of $h_1$. The area of $B_3$ may be calculated at various heights, to obtain a range of data points which may be graphed by plotting the height $h_1$ on the x-axis, and the area $B_3$ on the y-axis. For example, the data point when $h_1=0$ would be (0, B1). The data point when $h_1=h_2$ would be ($h_2$, $B_2$). Graphing programs may then be used to create a trendline based on the data points, and to calculate an equation to fit the trendline, thereby determining the relationship between $h_1$ and $B_3$ for a given cavity. A computational engine such as the WolframAlpha® software, which is available from Wolfram Alpha LLC of Champaign, Ill., may also be used to determine this relationship.

If tray 10 is filled with liquid, the depth of the liquid is $h_1$, which is the height of the cavity 12 from the base 32 to the lowest point 26 of the overflow notch 18. If the volume of the frozen solids formed by the tray were maximized such that the frozen solids reached the lowest points of the top edges 28, the depth of the liquid, initially at $h_1$, would expand to $h_2$ when frozen, where $h_2$ is the height of the cavity 12 from the base 32 to the lowest level of depressions 24. To calculate the dimensions required to achieve this expansion, it is necessary to know the expansion factor of the liquid when it changes state from a liquid to a solid. In the case of water, this factor is known to be approximately 9%.

The depth of the overflow notch 18 may be expressed as the height $h_{cavity}$ of the cavity 12 from the base 32 to the top, minus the height of the cavity from the base to the lowest point 26 of the overflow notch 18, as follows:

$$\text{Depth of Notch}=h_{cavity}-h_1$$

where $h_{cavity}$ is the height from the base 32 of the cavity 12 to the top level of top edge 28, and $h_1$ is the height from the base 32 of the cavity to the lowest point 26 of the overflow notch 18.

The optimal depth of the overflow notch 18, for use with water, may be determined by following the procedure set forth in the steps listed below. As used herein, the "optimal depth" is the depth of the overflow notch 18 at which, when an ice cube is formed, the top level of the ice cube reaches approximately the lowest point of depressions 24.

1) The cavity 12 is filled to the lowest point of depressions 24, prior to an overflow notch 18 being placed in the cavity.

2) The volume of liquid from step 1 is measured by transferring it to a graduated cylinder or other measuring apparatus.

3) Because the expansion factor of water is approximately 9% when water changes state from a liquid to a solid, the following equation is applicable when the cavities are filled with pure water:

$$V_1\times1.09=V_2\text{, or alternatively,}$$

$$V_2/1.09=V_1$$

where $V_1$ is the volume of water when the cavity 12 is filled to the lowest point 26 of the overflow notch 18, and $V_2$ is the volume of water when the cavity is filled to the lowest point of depressions 24. The volume measured above in step 2 is $V_2$. Therefore, $V_1$ is calculated by dividing the volume measured in step 2 by 1.09.

4) The cavity is filled with the volume of liquid determined above in step 3, which is $V_1$.

5) The vertical distance from the base 32 of the cavity 12 to the surface of the liquid, $h_1$, is measured.

6) The distance determined above in step 5 is subtracted from $h_{cavity}$, the height from the base 32 of the cavity 12 to the top level of top edge 28. The result of this subtraction is the optimal depth of the overflow notch 18. As stated above, $$\text{Depth of Notch}=h_{cavity}-h_1$$

This procedure could be used to determine an optimal depth of the overflow notch 18 for liquids other than water which expand when they freeze, by changing step 3 to reflect different expansion factors. For example, for a liquid which expands when frozen by 10%, $V_2$ would be divided by 1.10 to obtain $V_1$. For a liquid which expands when frozen by 5%, $V_2$ would be divided by 1.05 to obtain $V_1$.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A tray for forming frozen solids, comprising:

a first cavity and a second cavity, each cavity having a base;

a partition located between the first cavity and the second cavity, the partition comprising a pair of sidewalls and a top edge; and an overflow notch located in the top edge and extending down the pair of sidewalls, said overflow notch comprising an aperture in the top edge, wherein the aperture is adapted to allow liquid to exit the tray through the aperture.

2. The tray of claim 1, further comprising a depression located in the top edge, wherein a depth of the overflow notch is greater than a depth of the depression.

3. The tray of claim 1, the top edge comprising a raised feature at a corner shared by at least the first cavity and the second cavity.

4. The tray of claim 3, further comprising a depression located in the top edge, wherein the raised feature is adjacent to the depression.

5. The tray of claim 1, wherein the raised feature is adapted to direct a flow of liquid into at least the first cavity and the second cavity.

6. The tray of claim 1, wherein the overflow notch is V-shaped.

7. The tray of claim 1, wherein the tray comprises a plurality of overflow notches.

8. The tray of claim 1, wherein the depth of the overflow notch is sufficient such that water frozen in the tray will not extend above a highest level of the top edge.

9. A tray for forming frozen solids, comprising:

a plurality of cavities, each cavity having a base;

a partition located between two adjacent cavities of the plurality of cavities, the partition comprising a pair of sidewalls and a top edge; and an overflow notch located in the top edge and extending down the pair of sidewalls, said overflow notch comprising an aperture in the top edge, wherein the aperture is adapted to allow liquid to exit the tray through the aperture.

10. The tray of claim 9, further comprising a depression located in the top edge, wherein a depth of the overflow notch is greater than a depth of the depression.

11. The tray of claim 9, the top edge comprising a raised feature located at a corner shared by at least the two adjacent cavities.

12. The tray of claim 9, the top edge comprising a raised feature located at a corner shared by at least the two adjacent cavities and by two additional cavities of the plurality of cavities.

13. The tray of claim 12, further comprising a depression located in the top edge, wherein the raised feature is adjacent to the depression.

14. The tray of claim 12, wherein the raised feature is adapted to direct a flow of liquid into at least the two adjacent cavities and the two additional cavities of the plurality of cavities.

15. The tray of claim 9, wherein the overflow notch is V-shaped.

16. The tray of claim 9, wherein each tray comprises a plurality of overflow notches.

17. The tray of claim 9, wherein the depth of the overflow notch is sufficient such that water frozen in the tray will not extend above a highest level of the top edge.

18. A method of forming frozen solids, comprising:

providing a tray comprising:

a first cavity and a second cavity, each cavity having a base;

a partition located between the first cavity and the second cavity, the partition comprising a pair of sidewalls and a top edge; and an overflow notch located in the partition and extending from the top edge down the pair of sidewalls, said overflow notch comprising an aperture in the top edge, wherein the aperture is adapted to allow liquid to exit the tray through the aperture;

pouring liquid into the tray until each cavity contains liquid up to the level of the aperture of the overflow notch;

placing the tray in a freezer; and removing the tray from the freezer when the liquid in each cavity has frozen, such that each cavity contains a frozen solid, wherein the frozen solid in each cavity extends from the base of the cavity to a level at or below a highest level of the top edge of the partition cavity.

19. The method of claim 18, wherein the frozen solid in the first cavity is disconnected from the frozen solid in the second cavity.

20. The method of claim 18, further comprising stacking the tray on top of a bottom tray prior to pouring liquid into the tray.

* * * * *